US005374776A

United States Patent [19]

Saito et al.

[11] Patent Number: 5,374,776

[45] Date of Patent: Dec. 20, 1994

[54] SYSTEM FOR PROCESSING MUSICAL SOUND DATA HAVING OVERFLOW/UNDERFLOW COMPENSATION

[75] Inventors: Tsutomu Saito, Iwata; Yutaka Washiyama, Hamamatsu; Yoichi Nagashima, Hamana, all of Japan

[73] Assignee: Kawai Musical Inst. Mfg. Co., Ltd., Sizuoka, Japan

[21] Appl. No.: 116,553

[22] Filed: Sep. 7, 1993

Related U.S. Application Data

[63] Continuation-in-part of Ser. No. 456,218, Dec. 20, 1989, and a continuation of Ser. No. 774,744, Oct. 11, 1991, abandoned, which is a continuation of Ser. No. 432,903, Nov. 7, 1989, abandoned, said Ser. No. 456,218, is a continuation of Ser. No. 218,236, Jul. 12, 1988.

[30] Foreign Application Priority Data

Nov. 7, 1988 [JP] Japan ..... 63-281103

[51] Int. Cl.[5] ..... G10H 7/02

[52] U.S. Cl. ..... 84/627; 84/633; 84/663; 84/665

[58] Field of Search ..... 84/622-625, 84/627-632, 633, 648, 660, 663, 665, DIG. 10; 364/736.5, 737, 745; 341/83, 93

[56] References Cited

U.S. PATENT DOCUMENTS

| | | | |
|---|---|---|---|
| 3,763,364 | 10/1973 | Deutsch et al. | 84/604 |
| 4,520,347 | 5/1985 | Campbell, Jr. | 341/93 |
| 4,554,857 | 11/1985 | Nishimoto . | |
| 4,722,066 | 1/1988 | Armer et al. | 364/737 X |
| 4,833,963 | 5/1989 | Hayden et al. | 84/627 |
| 4,986,159 | 1/1991 | Matsushima et al. | 84/660 |

OTHER PUBLICATIONS

*Microelectronic Circuits;* Adel Sedra, Kenneth Smith; Pub. Holt, Rinehart and Winston; Co 1982; pp. 786-788.

*Primary Examiner*—William M. Shoop, Jr.
*Assistant Examiner*—Brian Sircus

[57] ABSTRACT

A system for use in an electronic musical instrument, which system includes a musical sound generating unit for generating a musical sound, and a detection unit for detecting that the magnitude of the musical sound data generated by the musical sound generating unit exceeds a processing capability, on the basis that the value indicated by the most significant bit prior to data processing not equal to that after data processing. A maintaining unit is also included which forcibly maintain the level of a signal representing the musical sound data at a maximum amplitude thereof, on the basis of the result of the detection effected by detection unit.

16 Claims, 11 Drawing Sheets

FIG. 3

20

PROCESSING PROGRAM
(FOR CPU)

TONE DATA
BANK DATA
DATA LENGTH SIGNAL DATA D816
GROUP DATA GR
LOOP TOP DATA
LOOP END DATA
ENVELOPE LEVEL DATA EL
ENVELOPE ADD-SUBTRACT
SIGNAL DATA EDU
THINNING-OUT DATA TH
ENVELOPE SPEED DATA ES

WAVEFORM DATA RD
⋮

FIG. 5

| | | | | | | | | | | | | | | | | | | | | |
|---|---|---|---|---|---|---|---|---|---|---|---|---|---|---|---|---|---|---|---|---|
| MMU ADDRESS | MM7 | MM6 | MM5 | MM4 | MM3 | MM2 | MM1 | MM0 | | | | | | | | | | | | |
| CPU ADDRESS | 0 | 0 | 0 | 0 | CA15 | CA14 | CA13 | CA12 | CA11 | CA10 | CA9 | CA8 | CA7 | CA6 | CA5 | CA4 | CA3 | CA2 | CA1 | CA0 |
| ROM ADDRESS | RA18 | RA17 | RA16 | RA15 | RA14 | RA13 | RA12 | RA11 | RA10 | RA9 | RA8 | RA7 | RA6 | RA5 | RA4 | RA3 | RA2 | RA1 | RA0 | |

FIG. 6

320

| | 15 | 14 | 13 | 12 | 11 | 10 | 9 | 8 | 7 | 6 | 5 | 4 | 3 | 2 | 1 | 0 | |
|---|---|---|---|---|---|---|---|---|---|---|---|---|---|---|---|---|---|
| 00 | BANK (B) | | | | ENVELOPE GROUP (B) | | | | BANK (A) | | | | ENVELOPE GROUP (A) | | | | CH0 |
| 01 | FREQUENCY NUMBER SPEED FS | | | | | | | | | | | | | | | | |
| 02 | KEY ON | D816 | GROUP GR | | — | | | | INITIAL FREQUENCY NUMBER | | | | | | | | |
| 03 | LOOP TOP | | | | | | | | LOOP END | | | | | | | | |
| 04 | BANK (B) | | | | ENVELOPE GROUP (B) | | | | BANK (A) | | | | ENVELOPE GROUP (A) | | | | CH1 |
| 05 | FREQUENCY NUMBER SPEED FS | | | | | | | | | | | | | | | | |
| 06 | KEY ON | D816 | GROUP GR | | — | | | | INITIAL FREQUENCY NUMBER | | | | | | | | |
| 07 | LOOP TOP | | | | | | | | LOOP END | | | | | | | | |
| ⋮ | ⋮ | | | | | | | | | | | | | | | | |
| 3C | BANK (B) | | | | ENVELOPE GROUP (B) | | | | BANK (A) | | | | ENVELOPE GROUP (A) | | | | CH15 |
| 3D | FREQUENCY NUMBER SPEED FS | | | | | | | | | | | | | | | | |
| 3E | KEY ON | D816 | GROUP GR | | — | | | | INITIAL FREQUENCY NUMBER | | | | | | | | |
| 3F | LOOP TOP | | | | | | | | LOOP END | | | | | | | | |
| 40 | PHASE 0 ENVELOPE LEVEL EL | | | | | | | EDU | THINNING-OUT | | ENVELOPE SPEED ES | | | | | | EG0 |
| 41 | PHASE 1 ENVELOPE LEVEL EL | | | | | | | EDU | THINNING-OUT | | ENVELOPE SPEED ES | | | | | | |
| 42 | PHASE 2 ENVELOPE LEVEL EL | | | | | | | EDU | THINNING-OUT | | ENVELOPE SPEED ES | | | | | | |
| 43 | PHASE 3 ENVELOPE LEVEL EL | | | | | | | EDU | THINNING-OUT | | ENVELOPE SPEED ES | | | | | | |
| 44 | PHASE 0 ENVELOPE LEVEL EL | | | | | | | EDU | THINNING-OUT | | ENVELOPE SPEED ES | | | | | | EG1 |
| 45 | PHASE 1 ENVELOPE LEVEL EL | | | | | | | EDU | THINNING-OUT | | ENVELOPE SPEED ES | | | | | | |
| 46 | PHASE 2 ENVELOPE LEVEL EL | | | | | | | EDU | THINNING-OUT | | ENVELOPE SPEED ES | | | | | | |
| 47 | PHASE 3 ENVELOPE LEVEL EL | | | | | | | EDU | THINNING-OUT | | ENVELOPE SPEED ES | | | | | | |
| ⋮ | ⋮ | | | | | | | | | | | | | | | | |
| 7C | PHASE 0 ENVELOPE LEVEL EL | | | | | | | EDU | THINNING-OUT | | ENVELOPE SPEED ES | | | | | | EG15 |
| 7D | PHASE 1 ENVELOPE LEVEL EL | | | | | | | EDU | THINNING-OUT | | ENVELOPE SPEED ES | | | | | | |
| 7E | PHASE 2 ENVELOPE LEVEL EL | | | | | | | EDU | THINNING-OUT | | ENVELOPE SPEED ES | | | | | | |
| 7F | PHASE 3 ENVELOPE LEVEL EL | | | | | | | EDU | THINNING-OUT | | ENVELOPE SPEED ES | | | | | | |

| 8 | 7 | 6 | 5 | 4 | 3 | 2 | 1 | 0 |
|---|---|---|---|---|---|---|---|---|
| EDU | TH1 | TH0 | ES5 | ES4 | ES3 | ES2 | ES1 | ES0 |

SYSTEM FOR PROCESSING MUSICAL SOUND DATA HAVING OVERFLOW/UNDERFLOW COMPENSATION

This application is a continuation of application Ser. No. 07/774,744 filed on Oct. 11, 1991, which is a continuation of Ser. No. 07/432,903 filed on Nov. 7, 1989 which are now both abandoned. This application is a continuation-in-part of prior U.S. application Ser. No. 07/456,218 filed Dec. 20, 1989 to Tadashi Matsushima and Tsutomu Saito, which is a continuation application prior U.S. application Ser. No. 07/218,236 filed on Jul. 12, 1988.

BACKGROUND OF THE INVENTION

1. Field of The Invention

This invention generally relates to an electronic musical instrument, and more particularly, a musical sound data processing system for processing musical sound data when the magnitude of musical sound data exceeds the processing capacity of the electronic musical instrument.

2. Description of the Background Art

When the magnitude of data of the musical sound to be processed exceeds processing capacity, a conventional system performs a special processing by providing a special processing bit therein and changing the value represented by the special processing bit. In such a conventional system, however, quantity magnitude of data becomes larger and thus the number of bits assigned to the musical sound data becomes smaller, making it difficult to obtain a fine waveform. Further, even if the number of bits assigned to the musical sound data is not reduced, the conventional system has drawbacks in that the data processing cannot be smoothly performed due to the increased processing required due to the use of the special bit, and further, the configuration of the circuit is made complex because of the increased processing required due to the use of the special bit.

The present invention is intended to eliminate the above-described defects of the conventional systems.

SUMMARY OF THE INVENTION

Accordingly, an object of the present invention is to provide a musical sound processing system which can smoothly perform processing even when the magnitude of data is in excess of the processing capability, by representing musical sound data by using bits of the smallest possible number.

To attain the above objects, and in accordance with this present invention, there is provided a musical sound data processing system which comprises a musical sound generating means for generating musical sound data, a detection means for detecting that the magnitude of the musical sound data generated by the musical sound generating means exceeds a processing capability on the basis of a finding that the value indicated by the most significant bit prior to data processing is not equal to that after the data processing, a maintaining means for forcibly maintaining the level of a signal representing the musical sound data at a maximum amplitude thereof on the basis of the result of the detection effected by the detection means, whereby it can be detected, without providing a special processing bit, that the magnitude of the musical sound data exceeds the processing capability. Further, the magnitude of data to be processed can be reduced, and the construction of the circuit can be simplified.

An example of this system is below. Referring to FIG. 11, the sector 906 outputs the level of the maximum amplitude from a terminal group B thereof in response to the difference between the value indicated by the most significant bit of the accumulated value of the musical sound data just prior to the adder 901 and that indicated by the most significant bit of the accumulated value of the musical sound data just after the adder 901.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

Other features, objects and advantages of the present invention will become apparent from the following description of a preferred embodiment with reference to the drawings, in which like reference characters designate like or corresponding parts throughout which are given by way of illustration only, and thus are not limitative of the present invention, and wherein:

FIG.3 is a diagram showing the contents stored in a ROM 20;

FIG.5 is a diagram showing the relationship between the address data of a central processing unit 300 and that of a read-only memory 20;

FIG. 6 is a diagram illustrating the contents stored in an assignment storing memory 320 of an assignment storing circuit 32;

DESCRIPTION OF THE PREFERRED EMBODIMENT

Hereinafter, a preferred embodiment of the present invention will be described with reference to the accompanying drawings.

1. OUTLINE OF ENTIRE CONSTRUCTION OF AN EMBODIMENT

Figure 1:
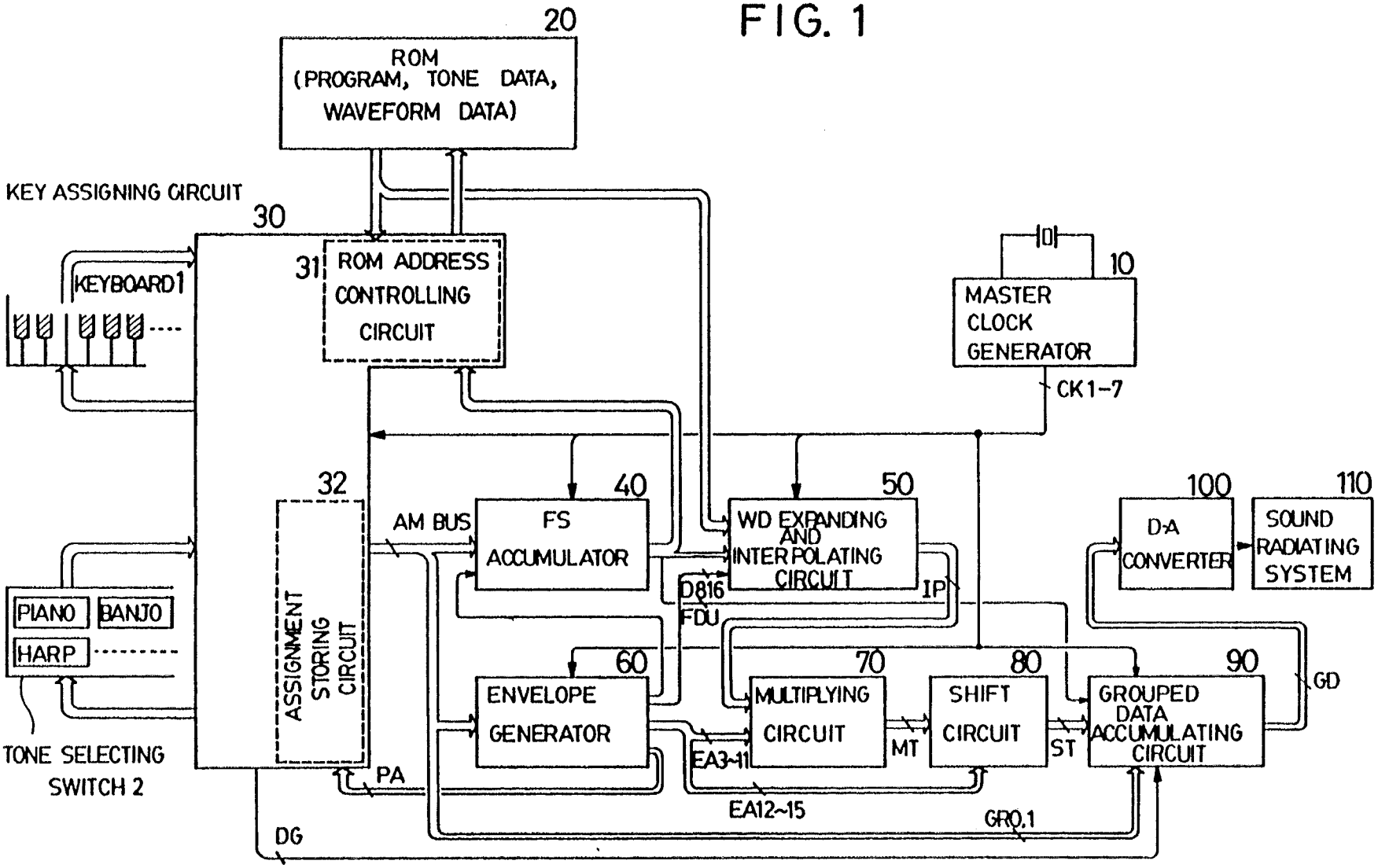
FIG.1 is a schematic block diagram showing the entire construction of an embodiment of the present invention.

FIG. 1 is a schematic block diagram showing the entire construction of an embodiment of the present invention, wherein each key of a keyboard 1 and each switch of a tone selecting switch board 2 are scanned by a key assigning circuit 30 (hereinafter referred to simply as a key assigner), and then data of a musical sound having a sound pitch corresponding to an operated key and a tone color corresponding to an operated switch is assigned to an idle channel of a 16 channel musical sound generating system of this embodiment. Further, information on the assignment of the data of the musical sound to the channel is stored in an assignment storing circuit 32.

Figure 4:
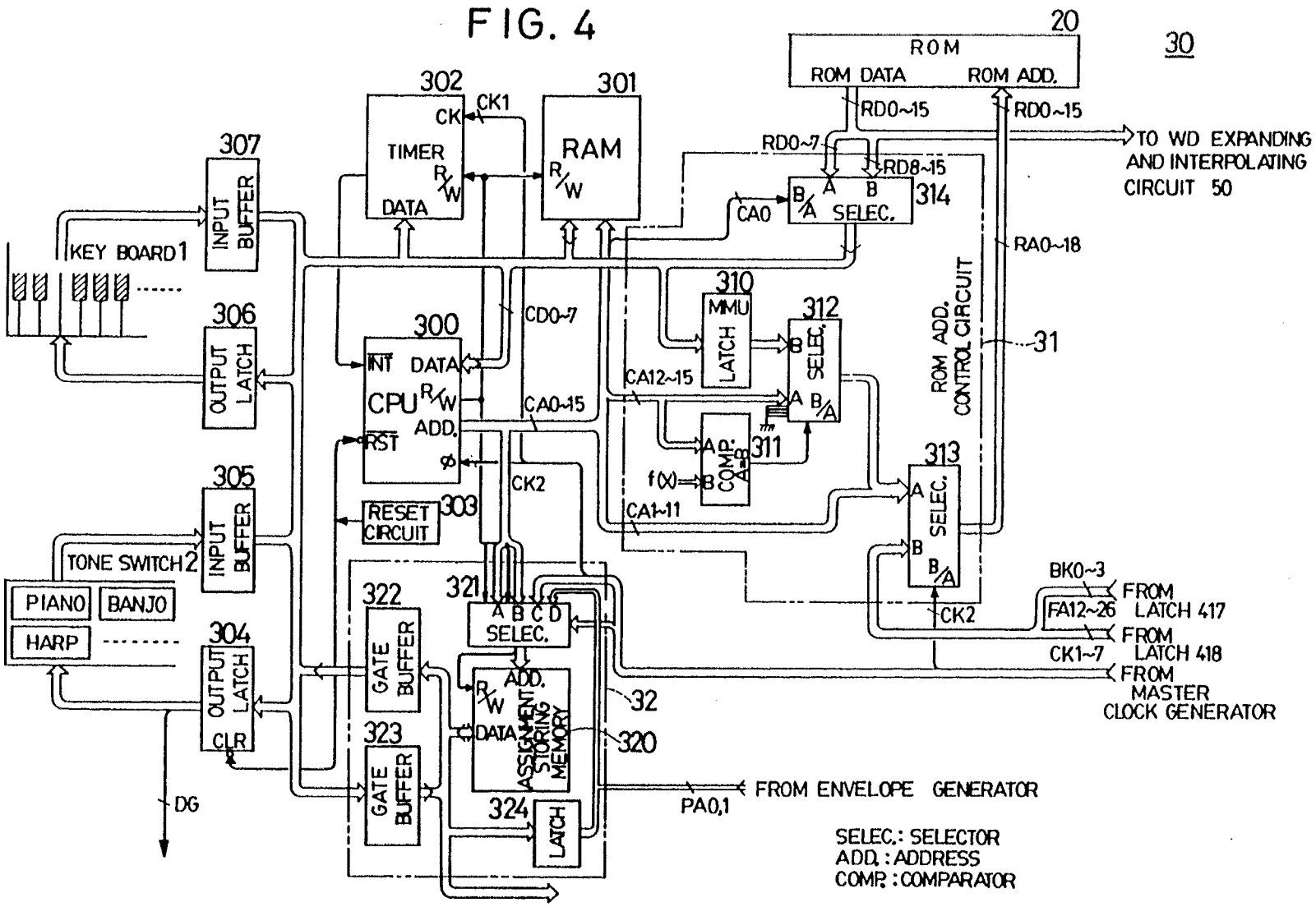
FIG.4 is a schematic block diagram showing the construction of the key assigning circuit 30.

A read-only memory (ROM) 20 stores a processing program for generating musical sound signals, tone data relating to waveforms of musical sounds and concerning envelopes used for generating musical sounds and waveform data RD. A ROM address control circuit 31 controls the addressing of locations in the ROM 20, from which the program and the data are read out, to change a reading from one of the processing program, the tone data and the waveform data to another thereof. The processing program read out of the ROM 20 is sent to a central processing unit (CPU) 300 of the key assigner 30, as shown in FIG. 4 where various processes are performed. Further, the tone data read out of the ROM 20 is written into an area, which corresponds to the idle channel, of the assignment storing circuit 32, and waveform data RD similarly read from the ROM 20 is sent to a waveform data (WD) expanding and interpolating circuit 50. In the assignment storing circuit 32, frequency number speed data FS corresponding to the key operated in the keyboard 1 is also written into the area corresponding to the idle channel.

Frequency number speed data FS corresponding to each channel is sequentially accumulated in a frequency number speed data accumulating device (hereinafter referred to simply as an FS accumulator) 40 and is further supplied to the ROM address controlling circuit 31 as data (hereinafter referred to simply as reading address data) of addresses of the ROM 20 from which the waveform data RD are read out. Accordingly, the waveform data RD corresponding to the frequency number speed data FS (i.e., corresponding to the pitch of the sound) is read out of the ROM 20 and input to the WD expanding and interpolating circuit 50. A large amount of waveform data RD is stored in the ROM 20 and selectively read therefrom in accordance with bank data read out of the assignment storing circuit 32. In the WD expanding and interpolating circuit 50, difference data, obtained by data compression of the waveform data RD read from the ROM 20, is expanded, and interpolating positions between successive sampling positions of each waveform data RD are obtained. Further, the expanded data and the thus-obtained data indicating the interpolating positions are sent to a multiplying circuit 70. The interpolation of the waveform data RD is effected by using a part of data, sent from the FS accumulator 40, indicating the values of the accumulated frequency number speed data FS.

On the other hand, the data relating to the envelope is sent from the assignment storing circuit 32 to an envelope generator 60 which generates envelopes, and thereafter, the thus-generated envelopes are sent therefrom to the multiplying circuit 70, whereupon each value obtained by sampling the expanded and interpolated waveform data IP resulting from the expansion and interpolation of the waveform data RD effected in the circuit 50 is multiplied by each value EA obtained by sampling an envelope waveform. Data ST indicating the result of the multiplication is then sent to and shifted by a shift circuit 80, and the thus-shifted data is grouped by a sound generating system and used to generate sounds therefrom; the data of each group being separately accumulated in a grouped data accumulating circuit 90. Further, the data of each group is sent through a digital-to-analog (D/A) converter 100 to a sound radiating system 110, which radiates musical sounds in accordance with the converted data.

The envelope generator 60 sends a signal PA indicating a current phase to the assignment storing circuit 32, and the circuit 32 outputs envelope data relating to the next phase. The envelope generator 60 also sends an on-event signal to the FS accumulator 40 at the star of a "key on" state, i.e., turning on the key to make the accumulator 40 start accumulating the data FS. Furthermore, the envelope generator 60 sends a data length signal D816 to the WD expanding and interpolating circuit 50 which determines whether or not the interpolation of the waveform data RD is to be effected. The data length signal D816 indicates that the waveform data RD is composed of two sampled values, each of which is represented by using 8 bits, or that the data RD is composed of a sampled value represented by using 10 bits and a difference data represented by using 6 bits. Namely, when the sampled value represented by 10 bits and the difference data represented by 6 bits are read, the interpolation of the waveform data RD is effected.

The shift circuit 80 shifts the data ST, obtained by the multiplication, from left to right (i.e., the data is shifted down) in accordance with the magnitude of an envelope power data, represented by high order bits EA12--EA15 of the accumulated value EA of the envelope, so that the radiated musical sound corresponds to natural sound by giving an exponential form to attenuating portions of the envelope corresponding to an attack time and a release time. Note, reference characters referring to consecutive elements such as EA12–EA15 are abbreviated as EA12–15 in this specification, and further, reference characters referring to two elements such as EA11 and EA14 are sometimes abbreviated as EA11, 14.

Figure 2:
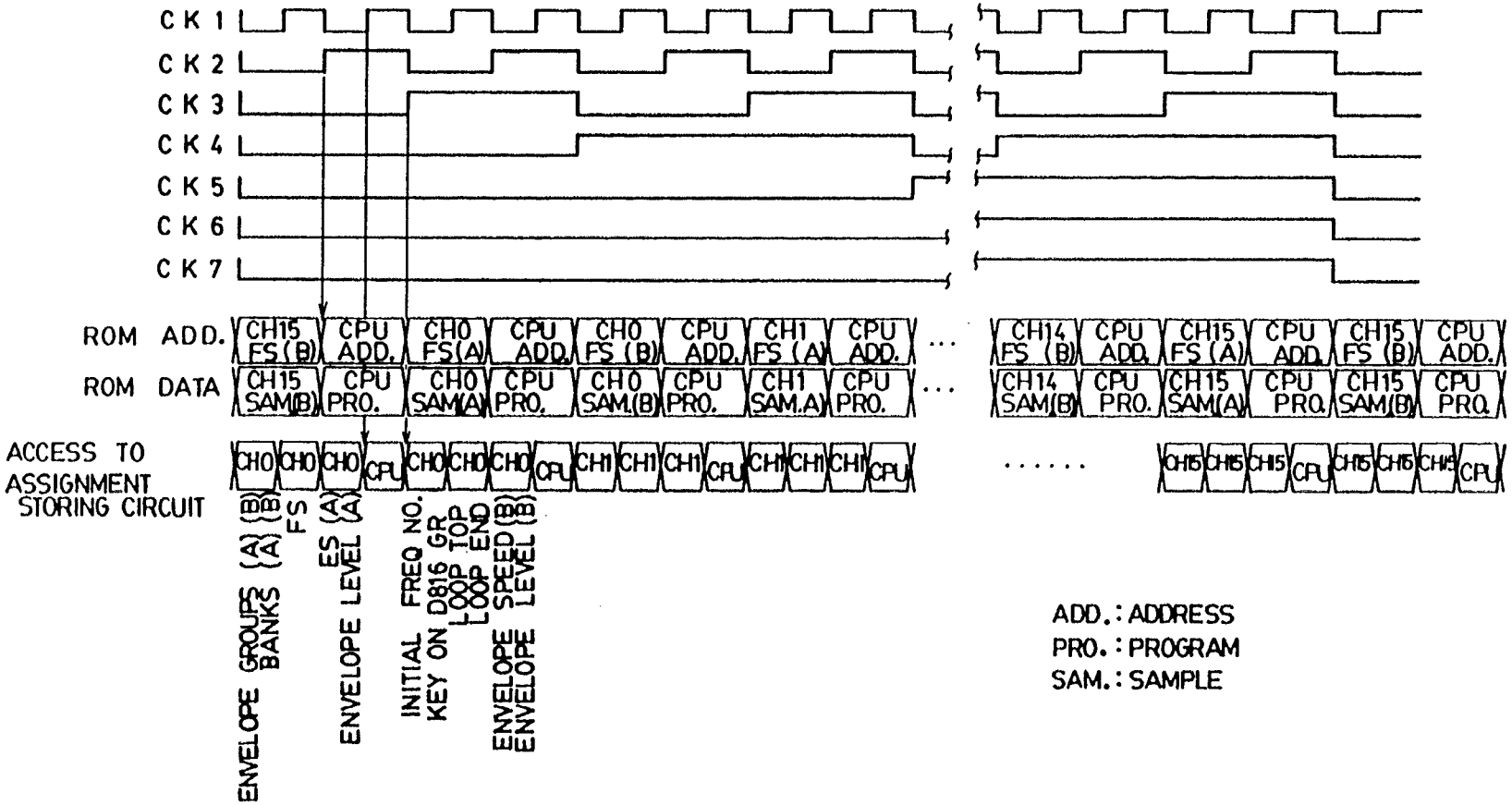
FIG.2 is a time chart for illustrating the operations of the circuits of FIG.1 and a key assigning circuit 30.

Further, four musical sound generating groups of the data are formed in the D/A converter 100 in a time sharing manner. In response to group data GR sent from the assignment storing circuit 32, the grouped data accumulating circuit 90 determines to which of the musical sound generating groups the data ST received from the shift circuit 80 belongs. This circuit 90 is also supplied by the FS accumulator 40 with a waveform folding signal FDU having a level which becomes high when the generation of a preceding or first half of the waveform of one period or cycle is finished and the generation of the latter or second half of the waveform commences. The grouped data accumulating circuit 90 inverts the musical sound data in response to the signal FDU. Furthermore, a D/A gate signal DG is fed from the key assigner 30 to the circuit 90, which controls the output of the musical sound data to the D/A converter 100. On the other hand, a master clock generator 10 sends signals (for example, clock signals CK1–7), described later and as shown in FIG. 2, to the circuits 30, 40, 50, 60 and 90 of FIG. 1, to thereby control the timing of various operations of these circuits.

2.ROM 20

FIG. 3 shows the contents in the ROM 20. As shown in this figure, this ROM 20 stores a processing program for generating the musical sound signals, tone data relating to the waveforms of musical sounds and concerning the envelopes used for generating musical sounds, and the waveform data RD. The top address of the storage area used for storing the tone data is separated from that of the storage area for storing the processing program, by MMU address data, as will be explained later. The tone data is composed of bank data, the data length signal data D816, the Group data GR, initial frequency number data, loop top data, loop end data and envelope data. The envelope data consists of phase level data or phase parameters PH, envelope add-subtract signal data EDU, thinning-out data TH, and envelope speed data ES.

First, the bank data is used for selecting and designating one of a plurality of the waveform data RD, and two waveforms (A) and (B) are selected per tone assigned to one channel on the basis of the bank data.

Next, as described above, the data length signal D816 is used for indicating that the waveform data RD is composed of two sampled values each represented by using 8 bits, or that the data RD is composed of one sampled value represented by using 10 bits and one difference data represented by using 6 bits.

Further, as above stated, the group data GR is used for indicating to which of four musical sound generating groups the data ST obtained by the multiplication is assigned.

Figure 7:
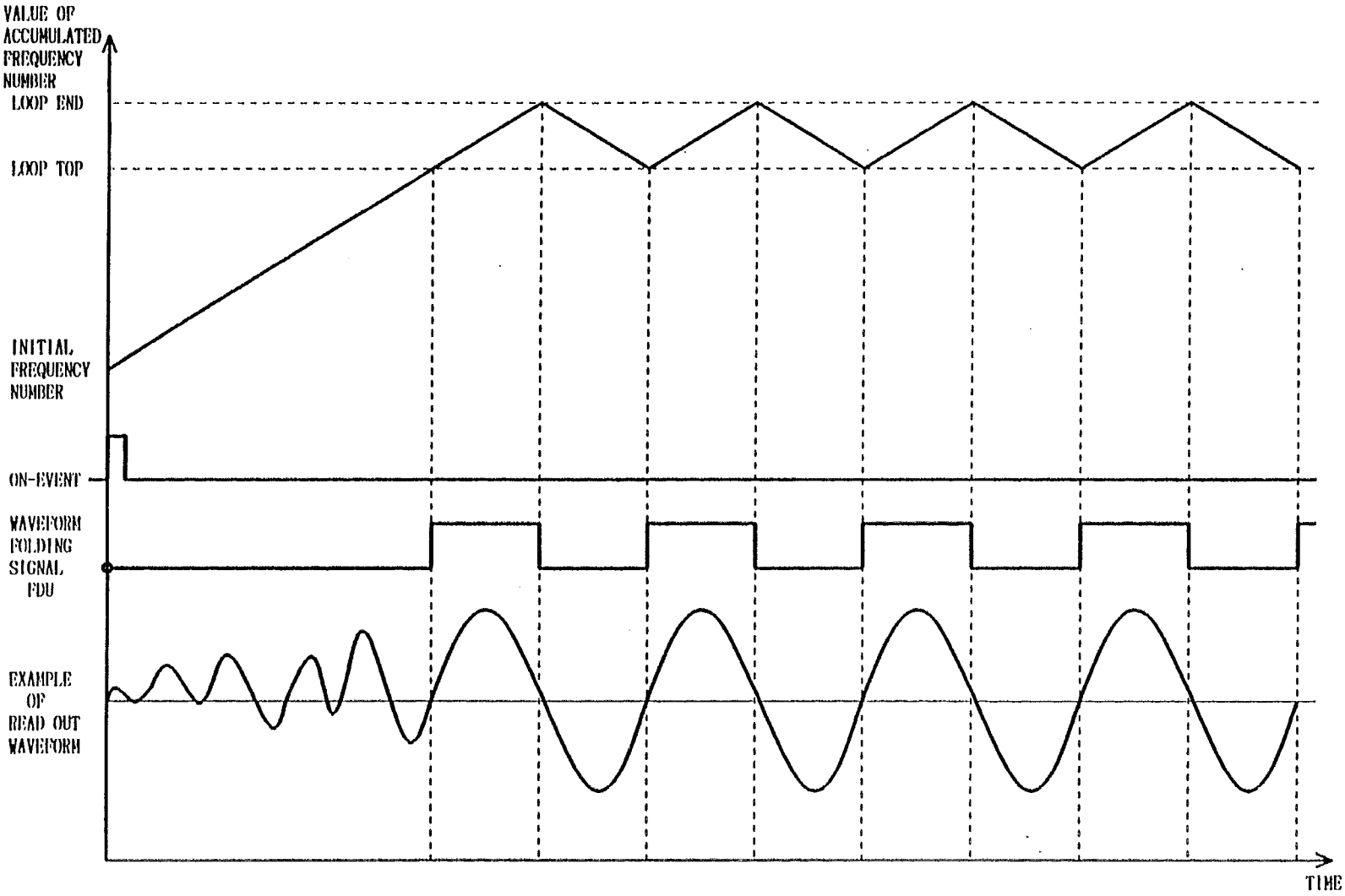
FIG.7 is a diagram illustrating the manner of reading the waveform data.

Referring now to FIG. 7, at the initiation of the operation of reading the waveform data RD from the ROM 20, an initial value of a parameter or variable used for sequentially accumulating the frequency number speed data FS and reading out the waveform data RD is indicated by the initial frequency number data. The loop end data indicates the value of the accumulated frequency number FA at an upper turning point by which the value of the accumulated frequency number FA is calculated by serially adding the frequency number speed data FS thereto, and further the loop top data indicates the value of the accumulated frequency number FA at a lower turning point from which the value of the accumulated frequency number FA is calculated by serially subtracting the frequency number speed data FS therefrom. As shown in this figure, the waveform data of the waveforms of first and second half cycles composing the continuous waveform of one cycle can be read out by repeatedly varying the value of the accumulated frequency number FA between the values indicated by the loop top data and the loop end data.

Note, the waveform folding signal FDU indicates the most significant bit of the accumulated frequency number FA. Further, the level of the signal FDU becomes high when the first half cycle is finished and the second half cycle commences. The above described change in the accumulating operation at the turning points (i.e., the change between the addition and the subtraction of the data FS) as well as the inversion of the sign of the sampled values of the waveform data (i.e., the sign of the values of the amplitude of the waveforms, and thus that of the musical sound data) is made on the basis of this signal FDU.

The envelope level data of the envelope data indicates the accumulated value of the envelope at the last or terminating point of the attack phrase, the decay phrase, the sustain phrase and the release phase. The envelope add-subtract signal data EDU indicates whether an addition or subtraction of the accumulated value EA is to be performed, and the envelope speed data ES of the envelope data indicates the rate or speed of the addition or subtraction of the accumulated value EA of the envelope. The gradient at each point of the envelope waveform is in proportion to the value of the envelope speed data ES. The envelope speed data ES and envelope level data EL are determined in accordance with key touch data obtained in response to the speed and the pressure by which the key is pressed.

The thinning-out data TH of the envelope data indicates the rate of thinning out of the accumulated values EA by latches (hereinafter referred to simply as the latch thinning-cut rate) for fetching the accumulated values EA into an accumulating system. Originally, the latching of the accumulated values EA is performed once every time slot repeated with respect to all of the channels, but where the data TH is "11", the thinning of the values EA is not performed, and conversely, where the data TH is "10", "01" and "00", the value EA is fetched into the accumulating system at each of 4 times, 16 times and 64 times of the latching thereof, respectively. The numerals 0 and 1 of the above described representation "00", "01", "10" and "11" of the data TH correspond to binary logical levels indicating a low state and a high state, respectively. By this thinning-out operation, if the value of the envelope speed data is not changed, a two-fold, four-fold, sixteen-fold and sixty-and-four-fold increase in the speed of generating the envelope can be achieved. The thinning-out data TH may be varied in accordance with the key touch data obtained in response to the speed and the pressure by which the keys of the keyboard 1 are pressed.

As described above, the ROM 20 stores the processing program for generating and radiating the musical sound and the musical sound data representing the contents or properties of the musical sound, and thus the provision of only a single memory for storing the processing program and the musical sound data in the apparatus simplifies the configuration of the circuits thereof.

3. KEY ASSIGNING CIRCUIT 30

FIG. 4 is a schematic block diagram showing the construction of the key assigning circuit 30. The CPU 300 shown in this figure is operative only when a master clock signal (CK2) is at a high level. As seen from FIG. 2, data relating to the CPU 300 flows through data and address bus lines only when the master clock signal CK2 is at a high level (corresponding to "1"), and conversely this other data not related to the CPU 300 flows therethrough when the master clock signal is at a low level (corresponding to "0").

4. ROM ADDRESS CONTROLLING CIRCUIT 31

The address data sent from the CPU 300 for accessing the ROM 20 and other storage devices is represented by using 16 bits CA0–15. As shown in FIG. 4, the data indicated by the low order bits CA1–11, excepting the least significant bit CA0, is supplied to a selector 313. On the other hand, data formed by adding four bits "0000" to the four bits CA12–15 as upper bits thereof is fed to the ROM 20 through the selector 313 as address data represented by using 19 bits together with the lower bits CA1–11, whereby the reading of the processing program is mainly performed. Further, when the CPU 300 reads tone data and so forth other than the processing program, the MMU address data represented by using 8 bits is output through the data bus line, the MMU latch 310 and the selector 312. The MMU address data is further added to the eleven low order bits CA1–11 and supplied to the ROM 20 through the selector 313.

FIG. 5 is a diagram showing such a modification of this data. Although the ROM address data RA0–18 is represented by using 19 bits, the address data CA0–15 (hereinafter referred to as CPU address data) output by the CPU 300 is represented by using 16 bits, and thus, the four bits "0000" and the MMU address data are added to the CPU address data. Further, by selectively adding the MMU address data or the four bits "0000" to the CPU address data, a reading by the CPU 300 from the processing program can be easily changed to a reading from the tone data, and vice versa. Furthermore, even where the CPU address data is represented by using bits having a number less than that of bits used for representing the ROM address data, the whole area of the ROM 20 can be read by such a simple modification of the CPU address data.

Referring again to FIG. 4, the data represented by the four high order bits CA12–15 is supplied to a comparator 311, to which other data F(x) represented by using four bits is also supplied, and when the former data CA12–15 does not match the latter data f(x), the data formed by the bits "0000" and the address data CA1-2–15 is selected. When a match is made, a coincidence signal is supplied from the comparator 311 to the selector 312, and further, an MMU latch 310 is selected. Therefore, when the address data CA12–15 does not match the data f(x), the processing program to be executed by the CPU 300 is read out of the ROM 20. On the other hand, when a match is made, the tone data and so forth are read therefrom. This data f(x) may be dynamically established by the CPU 300 or preliminarily set as fixed data.

The bank data read by the CPU 300 from an assignment storing memory 320, which will be described in detail, as well as the values FA12–26 obtained by accumulating the data FS and sent from the FS accumulator 40, is supplied through the selector 313 to the ROM 20 from which the waveform data RD of a corresponding bank is obtained. Further, the above described data selection by the selector 313 is performed on the basis of the clock signal CK2 issued from the CPU 300, and thus as shown in FIG. 2, the reading from the processing program is changed and a sampled value of the waveform data RD is read and vice versa, in accordance with the ROM DATA signal shown in the lower part of this figure. Where the processing program is read out, the reading from the processing program can be further changed to a reading from the tone data, in accordance with the data f(x). Such a reading operation is repeatedly performed with respect to all of the 16 channels.

Among the data read from the ROM 20, the waveform data RD is sent to the WD expanding and interpolating circuit 50 without change. Conversely, the processing program and the tone data are each bisected into two data, each represented by using 8 bits, which are sent to the CPU 300 through a selector 314 or to the assignment storing memory 320 through a gate buffer 323. The data selection in the selector 314 is effected in accordance with the value of the least significant bit (LSB) CA0 of the address data CA sent from the CPU 300, whereby the fetching of the data from the ROM 20 is performed in accordance with the CPU 300. Further, even if the number of bits required to represent the data read out of the ROM 20 is greater than that of bits required to represent data transferred on the data bus line connected to the CPU 300, the data processing can be smoothly carried out.

5. ASSIGNMENT STORING CIRCUIT 32

FIG. 6 is a diagram illustrating the contents stored in the assignment storing memory 320 of the assignment storing circuit 32. Memory areas for storing the tone data of 16 channels are formed in the assignment storing memory 320, and in each of the memory areas (hereinafter referred to as channel areas), the tone data sent from the ROM 20 is set. In this case, among the tone data to be set therein, the envelope data is set in each corresponding one of envelope group areas EGO–15, and the other data is distributed to and set in each of the channel areas CH0–15. The data to be set in the channel areas CH0–15 is composed of the bank data (A) and (B), the envelope group data (A) and (B), the frequency number speed FS, a key on signal data, the data signal D816, the group data GR, the initial frequency number data, the loop top data and the loop end data. Among this data, the data other than the frequency number speed data FS, the key on signal data, and the envelope group data (A) and (B) are as described above. The data FS corresponds to a sound pitch represented by the pressed key of the keyboard 1 and is used as data indicating the value of accumulated steps of address data for reading the waveform data RD. The key on signal data indicates that the apparatus is in a "key on" state, i.e., a key is turned on, and is equal to "1" in the "key on" state and to "0" in a "key off" state in which the keys are turned off. The envelope group data (A) and (B) indicate the addresses of the envelope group areas EG0–15 in which the envelope data corresponding to the tone data set in the channel areas is stored. Further, two envelope groups (A) and (B) exist because the tone data to be assigned to a channel is composed of two groups of data corresponding to two groups of musical sound data. Namely, two corresponding waveform data (A) and (B), and further two corresponding bank data (A) and (B), exist. Note, the envelope data, which is set in the envelope group areas EG0–15, is as described above in the description of the ROM 20.

The data read out of this assignment storing memory 320 is sent out through an assignment storing memory (AM) bus to the FS accumulator 40 and the envelope generator 60 and so on, and to the CPU 300 through the gate buffer 322. On the other hand, four-bit envelope group data (A) and (B) are again supplied to the assignment storing memory 320 through a selector 321 after the number of bits used for representing data (A) and (B) is increased to 7 by adding phase data represented by using 2 bits as data represented by higher order bits and adding the value "1" represented by using one bit as data represented by a lower order bit. Accordingly, the envelope level data EL, the thinning-out data TH, the envelope speed data and so forth, of the corresponding envelope, are read therefrom and sent to the envelope generator 60. The address data represented by a set of clock signals CK sent from the master clock generator 10, as well as the access address data supplied from the CPU 300, are also fed to the assignment storing memory 320.

FIG. 2 shows a time chart illustrating such a modification of the address data at the bottom thereof. First, the bank data (A) and (B), the envelope group data (A) and (B) and the frequency number speed data FS are read out of the memory 320, in this order, on the basis of the set of clock signals CK. Then the envelope speed data (A) ES and the envelope level data (A) EL are read therefrom on the basis of the envelope group data (A) and the phase data PA, and therefore, the CPU 300 is accessed. Following the access of the CPU 300, the initial frequency number data, the key on signal data, the data length signal data D816 and the group data GR are read out of the memory 320 on the basis of the set of the clock signals CK, and thereafter the loop top data and the loop end data are read. Then the envelope speed data (B) ES and the envelope level data (B) EL are read from the memory 20 on the basis of the envelope group data (B) and the phase data PA, and therefore, the CPU 300 is once more accessed. The above described process is repeatedly performed with respect to the data assigned to the 16 channels.

In this case, the signals CK1–17 of FIG. 2 are employed as the set of the clock signals CK used for representing the address data which indicates the data to be read. The selection of each address data is effected by the selector 321 on the basis of the clock signals CK1 and CK2. When 2-bit data, the value of the leftmost bit of which is represented by the clock signal CK2 and that of the rightmost bit is represented by the clock signal CK1, is "00" or "01", the set of the clock signals CK are selected as the address data. Further, when the 2-bit data is "10", the envelope group data and the phase data PA are selected as the address data. In addition, when the 2-bit data is "11", the address data sent from the CPU 300 is selected.

Data to be used in various intermediate processing is stored in a random-access memory (RAM) 301, and a timer 2302 supplies interrupt signals to the CPU 300 at intervals established by the CPU 300. A reset circuit 303 operates to reset the CPU 300 and an output latch 304 when the power is turned on. The sampling addresses of the keyboard 1 and the tone switch 2 are temporarily stored in the output latch 304 and another output latch 306. Further, the results of the sampling are input to input buffers 305 and 307. Note, a signal representing data of only a single bit of the sampling data set in the output latch 304 is used as a gate signal for the D/A converter 100.

9. MULTIPLYING CIRCUIT 70

Figure 8:
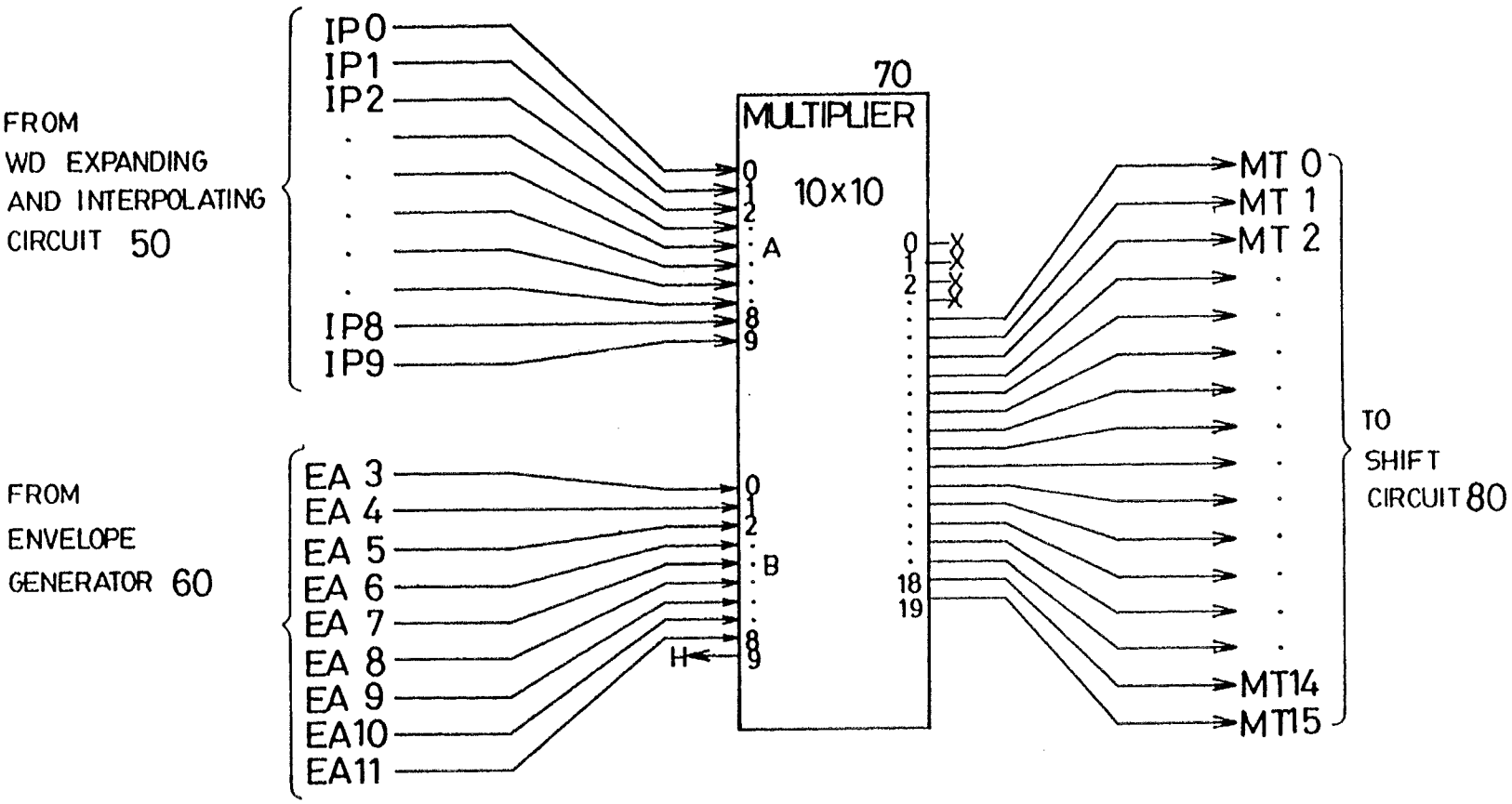
FIG.8 is a diagram showing the construction of a multiplying circuit

FIG. 8 is a circuit diagram showing the construction of the multiplying circuit (hereinafter referred to simply as the multiplier) 70. As shown in this figure, the interpolated waveform data IP0–9 composed of the sampled values of the waveform data RD and the interpolated values thereof sent from the WD expanding and interpolating circuit 50 is supplied to the multiplier 70. Further, the envelope mantissa data EA3–11 obtained by removing parts corresponding to 4 high order bits and 3 low order bits from the value EA0–15 fed from the envelope generator 60 is also supplied to the multiplier 70, whereupon the waveform data is multiplied by the envelope mantissa data.

At that time, the value "1" is added to the envelope mantissa data EA3–11 as data having a higher order than the MSB of the data EA3–11. This addition of data "1" to the mantissa data EA3–11 is equivalent to an operation given by the following equation $(1+M/2^9)$ where M denotes 9-bit data represented by the bits EA3–11 of the mantissa part of the value EA. Further, the resulting data of this operation is multiplied by the interpolated waveform data IP. The result of this multiplication is output from the multiplier 70 as data represented by using 20 bits, but as shown in this figure, 4 low order bits of this 20-bit data are truncated, and thus the data represented by using the remaining 16 bits (hereinafter referred to as the multiplication data) MT0–15 is output to the shift circuit 80.

10. SHIFT CIRCUIT 80

Figure 9:
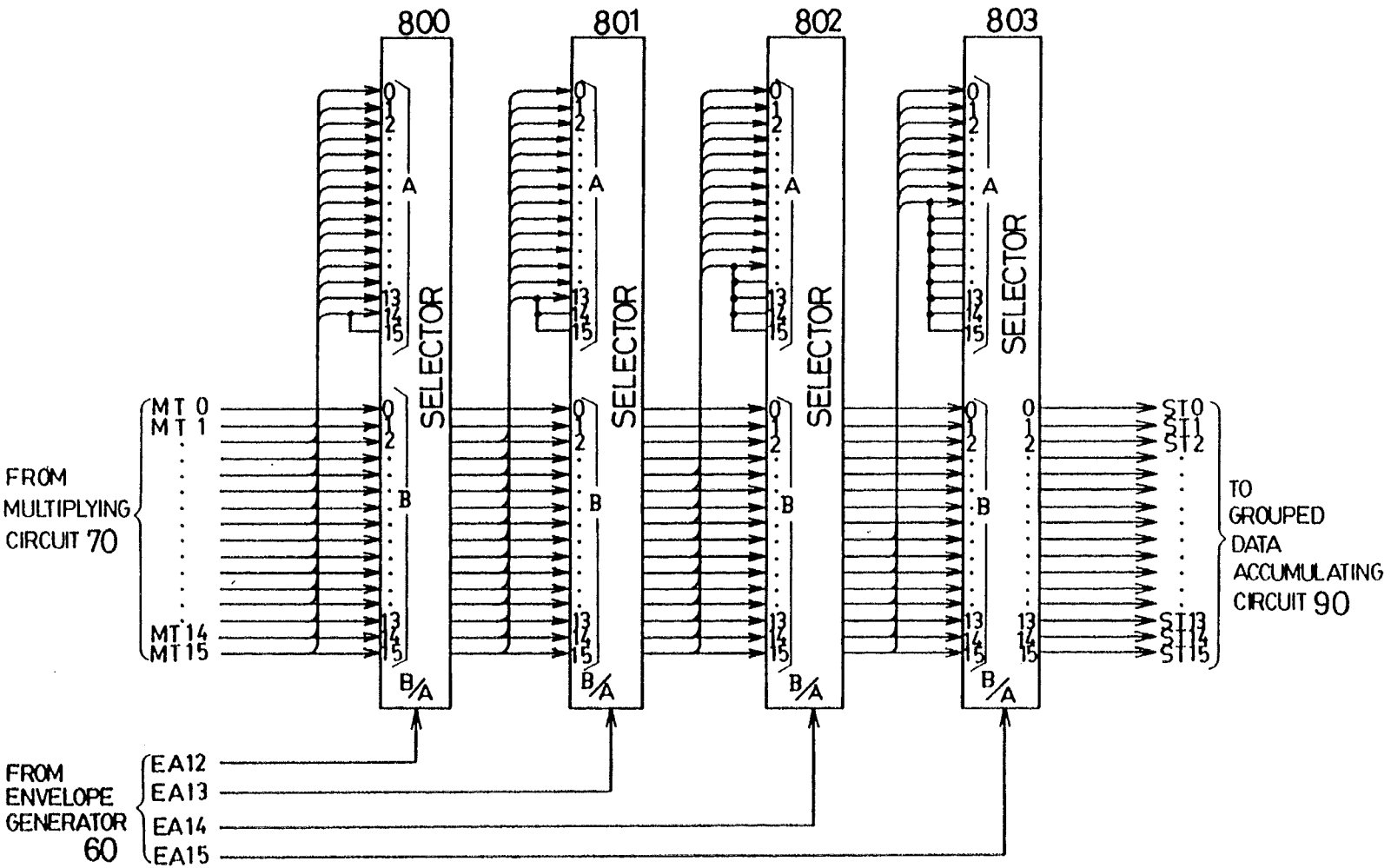
FIG.9 is a circuit diagram showing the construction of a shift circuit 80.

FIG. 9 is a circuit diagram showing the construction of the shift circuit. The multiplication data MT0–15 are shifted to the right by four selectors 800, 801, 802, and 803, corresponding to the envelope characteristic power data EA12–15, and the result is output to the grouped data accumulating circuit 90 as the musical sound data ST0–15.

The selector 800 shifts the multiplication data MT to the right by 1 bit when the selection signal EA12 indicates "0". Conversely, when the selection signal EA12 indicates "1", the selector 800 does not shift the data MT but outputs this data to the selector 801 without modification. Next, the selector 801 shifts the data MT to the right by two bits when the signal EA13 indicates "0". When the signal EA13 indicates "1", the selector 801 outputs the data MT without modification to the selector 802. Then the selector 802 shifts the data MT to the right by four bits when the value indicated by the signal EA14 is "0". Conversely, when the signal EA14 indicates "1", the selector 802 outputs the unchanged data MT to the selector 803, and thereafter, the selector 803 shifts the data MT to the right by eight bits when the signal EA15 indicates "0", and outputs the unchanged data MT to the grouped data accumulating circuit 90 when "1" is indicated.

Accordingly, the smaller the value indicated by the envelope characteristic power data, the larger the total number of bits shifted to the right. Further, assuming P denotes the value represented by the envelope power data EA12–15, then as is understood from the foregoing description, the value $2^{P-16}$ is calculated in this shift circuit 80. Thus, assuming R denotes the interpolated waveform data, an output of this shift circuit 80 becomes $2^{P-16}\times(1+M/2^9)\times R$. In this case, the "1" in parentheses can be omitted, and if this "1" is omitted, the input to the "9" terminal of the group B the multiplying circuit 70 is set as "0".

Figure 10:
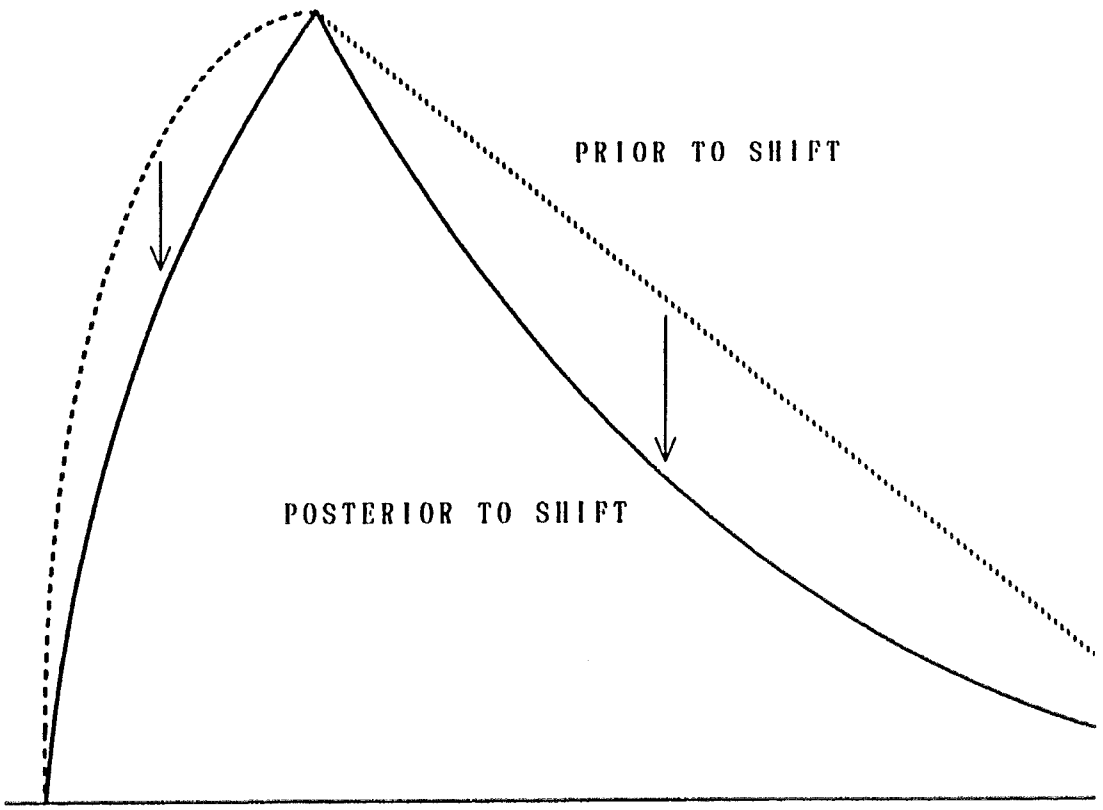
FIG.10 is a diagram illustrating the modification of the envelope waveform by a shift circuit 80.

Further, the lower the level of the envelope, the larger the proportion of the reduction due to the right-shifting to the level of the envelope, and thus, by shifting the data MT to the right as described above, the attenuating portion of the envelope waveform corresponding to the decay phase or the release phase is shaped like an exponential curve as shown in FIG. 10, in which the portion of the envelope waveform obtained prior to the shift is shown by a one-dot chain line and the portion of the envelope waveform obtained after the shift is shown by a solid line. Thereby, the sound radiated by the apparatus of the present invention can be closer to the natural sound.

11. GROUPED DATA ACCUMULATING CIRCUIT 90

Figure 11:
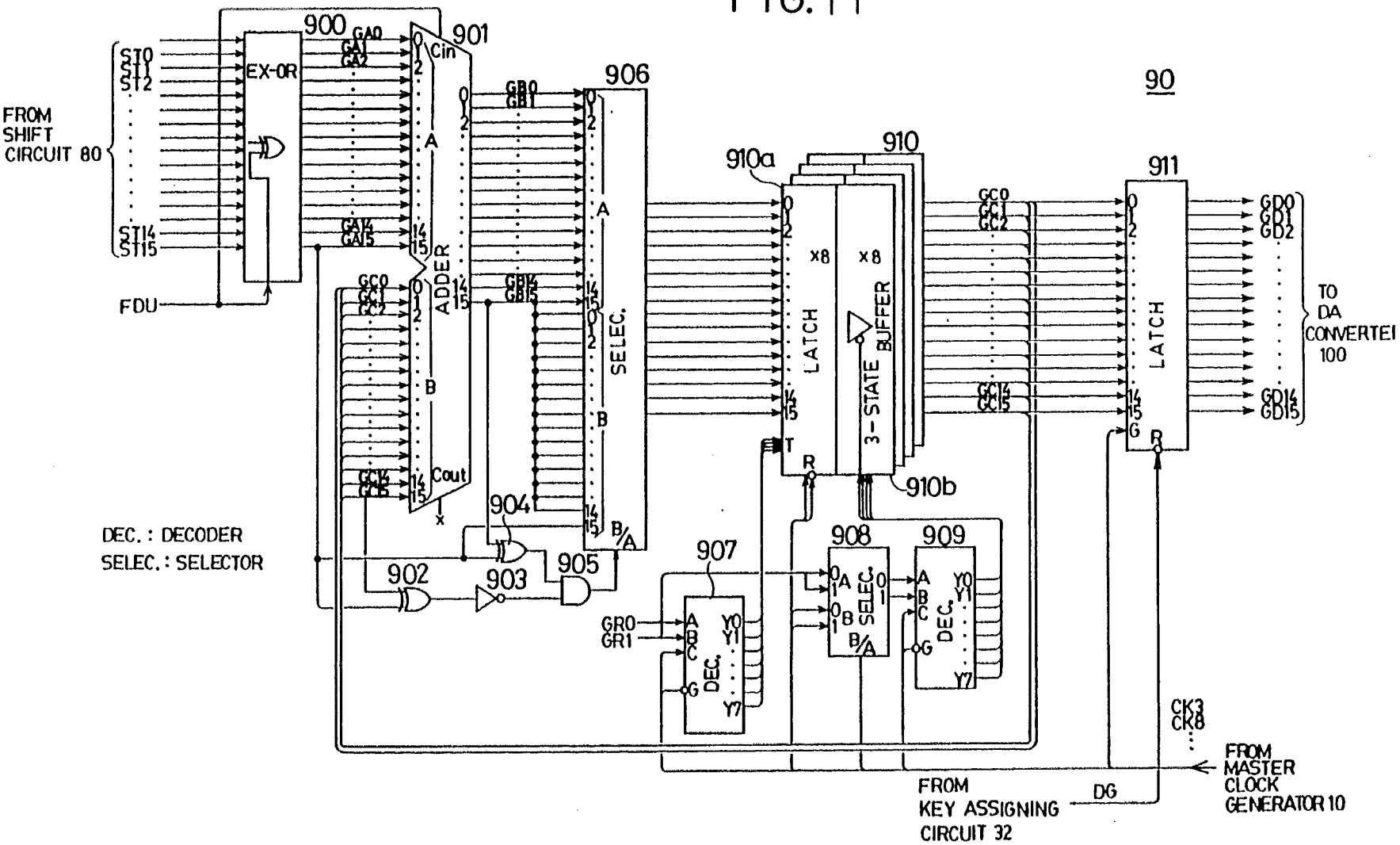
FIG. 11 is a circuit diagram showing the construction of a grouped data accumulating circuit 90.

FIG. 11 is a circuit diagram showing the construction of the grouped data accumulating circuit 90. The sound data ST0–15 from the shift circuit 80 is input through each gate of the group of EX-OR gates 900 to the group A inputs of adder 901. The waveform folding signal FDU is supplied to all of the group of EX-OR gates 900. When the value represented by the waveform folding signal FDU is "1" the value indicated by the sound data ST0–15 is inverted. Incidentally, waveform data of half wavelength is preliminarily stored in the ROM 20. When this waveform data is normally read therefrom, the waveform folding signal FDU represents "0". In contrast, when this waveform data is read therefrom by being reversed, the waveform folding signal FDU represents "1". In the latter case, the value of the waveform data is inverted and thus the waveform data of a wavelength is generated. The waveform folding signal FDU is also input to a Cin terminal of the adder 901, and when the sound data ST is inverted, the sound data ST is corrected by being increased by 1.

In the adder 901, the accumulated sound data GC0–15 of each group is added to the sound data GA input thereto through the group of EX-OR gates 900. The resultant data is input to and temporarily stored in latch buffers 910 through selector 906. Thereafter, the resultant data is fed to the adder 901 as new accumulated sound data GC0–15. Thus, the sound data GA serially sent to the adder 901 is accumulated.

Further, 15-bit data, each bit of which indicates the value indicated by the MSB GB15 of the accumulated sound data GB sent from the adder 901, is supplied to the group B inputs of the selector 906. Moreover, the MSB GA15 of the sound data GA is input to the group B inputs of the selector 906 as the MSB of the group B inputs thereof without change.

In a group of gates 902 to 905, an overflow or underflow is detected. Thereby, data selected in the selector 906 is changed. Namely, when an overflow occurs, the maximum positive value "011 . . . 1" is selected. Conversely, when an underflow occurs, the maximum negative value "100 . . . 0" is selected. A level of a signal representing each of the selected data is maintained at a maximum amplitude thereof.

This overflow or underflow is detected from the following two conditions. One of the conditions is determined in EX-OR gate 902 wherein it is determined if the sign of the sound data GA prior to accumulation thereof matches that of the accumulated sound data GC. The other of the conditions is detected in EX-OR gate 904 wherein it is detected if the sign of the sound data GA prior to accumulation thereof does not match that of the sound data GB after the accumulation thereof.

It is judged whether or not the sign of the sound data GA prior to accumulation thereof matches that of the accumulated sound data GC. An indication of whether the MSB GA15 of the sound data GA and the MSB GC15 of the sound data GC are of the same sign is supplied to an AND gate 905 through the EX-OR gate 902 and an inverter 903. If both a value indicated by the MSB GA15 and a value indicated by the MSB GC15 are positive (or negative), a match detecting signal indicating "1" is supplied from the inverter 903 to the AND gate 905.

It is judged whether or not the sign of the sound data GA prior to accumulation thereof matches that of the sound data GB after accumulation thereof. An indication of whether the MSB GA15 of the sound data GA prior to accumulation thereof and the MSB GB15 of the sound data GB after accumulation thereof is fed to the AND gate 905 through the EX-OR gate 904. If both of the values indicated by the MSB GA15 and that indicated by the MSB GB15 are not matched with each other, namely, both of them are not positive or not negative, a mismatch detecting signal indicating "1" is supplied from the EX-OR gate 904 to the AND gate 905. Even in the case where the value indicated by the MSB GA 15 of the sound data GA prior to accumulation thereof is not matched with that indicated by the MSB GB15 of the sound data GB after accumulation thereof, if the value indicated by the MSB GA15 prior to accumulation thereof and the value indicated by the MSB GC15 after accumulation thereof are not the same, there occurs neither an overflow nor an underflow. An output of the AND gate 905 is supplied to the selector 906 as a selection changing signal.

Accordingly, even when the accumulated value GB of the sound data overflows or underflows, the level of the amplitude of a sound signal can be maintained at the maximum level thereof. Therefore seldom used bits representing data to be processed can be omitted, and the magnitude of data to be processed can be substantially decreased.

The data GO0–15 are input to four latch buffers 910. Each latch buffer 910 is composed of eight latohes **910*a* and eight 3-state buffers 910*b* having substantially the same functions as a selector has. These eight latohes are divided into two groups to be alternately switched from one to the other, i.e., a group (a) used for accumulating the musical sound data and a group (b) used for outputting the accumulated value, each of which is composed of four latches. Further, each of the four latch buffers 910 corresponds to a different one of four groups or kinds of musical sounds formed by the D/A converter 100 and the sound radiating system 110**. The musical sound data of each group is generated and accumulated separately.

Further, sixteen channels CH0–15 are divided into four groups each corresponding to a different one of the four groups of the musical sound data. Namely, channels CH0–3 are assigned to a first group of the musical sound data; channels CH4–7 to a second group of the musical sound data; channels CH8–11 to a third group of the musical sound data; and channels CH12–15 to a fourth group of the musical sound data.

Figure 12:
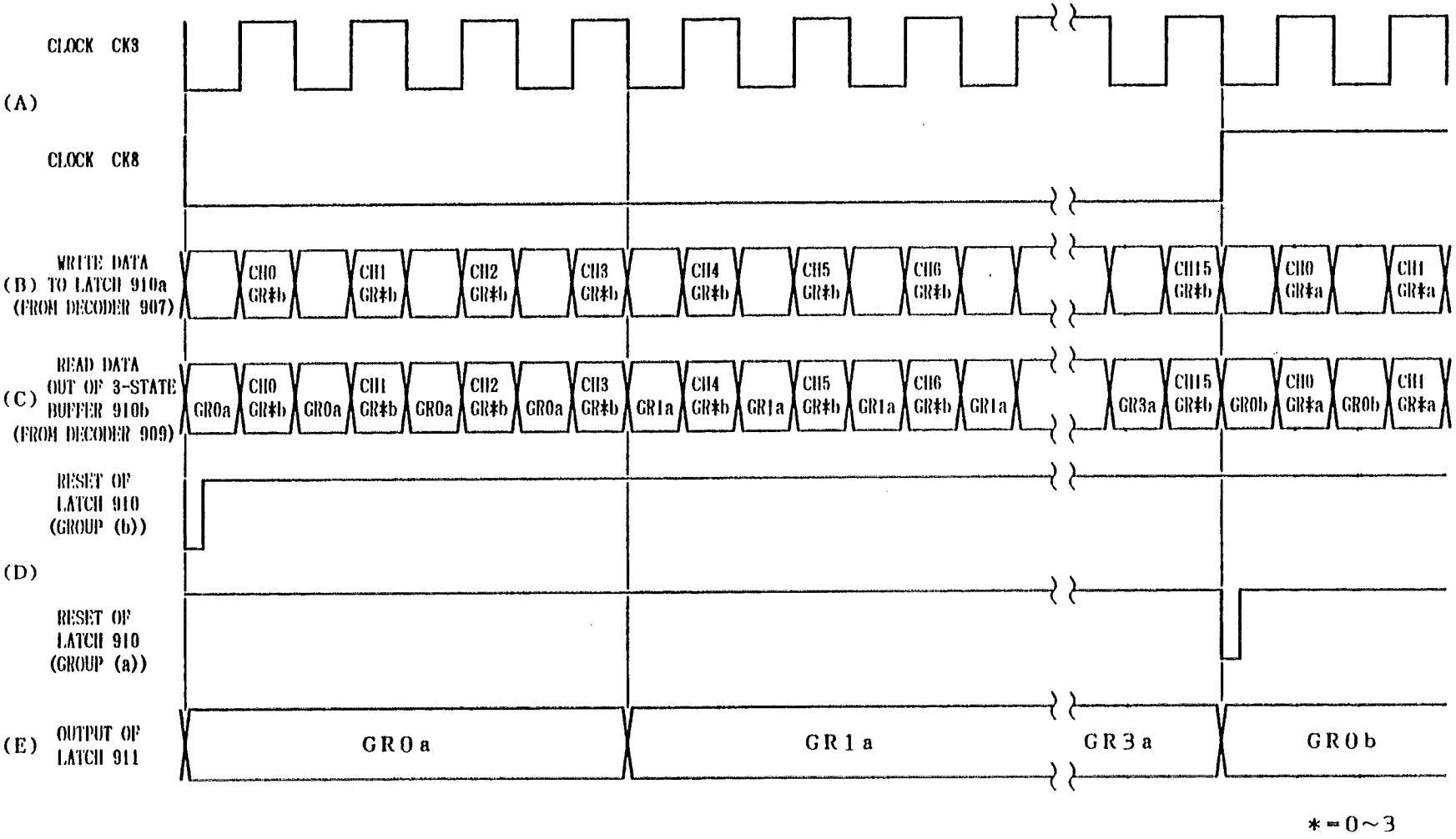
FIG. 12 is a timing chart for illustrating the operation of grouped data accumulating circuit 90 of FIG.11.

The group of the musical sound data is indicated by a group data GR0,1 from the assignment storing memory 32. A decoder 907 fetches the group data GR0,1 and the clock signal CK8 every time the clock signal CK3 shown in FIG. 12 (A) is received, and decodes them to sequentially select a latch to which the accumulated value in one of the latch buffers 910 is written. FIG. 12 (B) is a timing chart illustrating how such a processing is performed every time the clock signal CK3 input to the decoder 907 rises. In this figure, the reference characters GR*a and GR*b represent the groups of musical sounds. Further, in these reference characters, the symbol * indicates the number of the group of musical sounds corresponding to the channel indicated directly over the character GR*a or GR*b and takes a value 0, 1, 2 or 3. In addition, a character a (or b) positioned immediately after the character * represents the group a (or b) of the latches **910*a*** corresponding to the musical sound component (A) (or (B)).

The group data GR0,1 is also supplied through a selector 908 to a decoder 909. Further, this decoder 909 also fetches the group data GR0,1 and the clock signal CK8 every time the clock signal CK3 is received, and decodes them and controls the 3-state buffer to sequentially select a latch for reading the current accumulated value in one of the latch buffers 910. As shown in FIG. 12 (C), such a processing is performed in time slots indicated by only the group number GR0*a*, GR1*a*, GR2*a* . . . Conversely, another clock signal is supplied together with the clock signal CK8 to the decoder 909 every time the clock signal CK3 rises, the decoder 909 then decodes them and controls the 3-state buffer 910*b*, and sequentially selects a latch for reading the accumulated value stored in the latch buffer 910. This processing is effected in time slots indicated by sets of the channel number CH0, CH1 , . . . and the corresponding group number GR*a or GR*b, and thus the accumulation is performed in a latch only where the time of writing the accumulated value thereto is in accordance with that of reading the accumulated value therefrom. The reading of the accumulated musical sound data is effected in latches other than such a latch.

Further, the musical sound data GC from the latch buffer 910 is output through a latch 911 to the D/A converter 100. Referring to FIG. 12 (C), the latching of the data GC is effected by the latch 911 in time slots indicated by using only the group numbers GR0*a*, GR1*a*, GR2*a* . . . As shown in FIG. 12 (E), the data GS of each group is output by alternately using the latches of the group (a) and those of the group (b). Note, a pulse shown in FIG. 12 (D) is supplied from the master clock generator 10 to the latch buffers 10, whereby the latches of the group (a) and those of the group (b) are alternately reset. Furthermore, the latch 911 is reset by a D/A gate signal from the key assigning circuit 30.

Although a preferred embodiment of the present invention has been described above, it is understood that the present invention is not limited thereto and that various modifications can be made without departing from the spirit of the invention.

For example, the detection of an overflow or underflow is not limited to the time just prior to or after the accumulation of the musical sound data and may be performed when accumulating the frequency number used for reading the waveform data, accumulating the envelope data used for generating the envelope waveform, and during other processes such as the addition, subtraction, multiplication, and division of other data.

The scope of the present invention, therefore, is determined solely by the appended claims.

We claim:

1. A musical sound data processing system comprising:

waveform storage means for storing a plurality of musical sound data of a half wavelength;

musical sound generating means for sequentially generating the plurality of musical sound data of the half wavelength, which is stored in said waveform storage means, in a time sharing manner;

detection signal output means for outputting a detection signal which is indicative of a period of the half wavelength of musical sound data generated by said musical sound generating means;

changing means, coupled to said musical sound generating means for sequentially receiving and outputting each of the musical sound data generated by said musical sound generating means in a time sharing manner, during a first half wavelength period, and for sequentially outputting the musical sound data generated by said musical sound generating means in a time sharing manner inverted, during a second half wavelength period, in accordance with the detection signal;

musical sound accumulating means, coupled to said changing means, for accumulating and sequentially adding the output of said changing means to a previous value of accumulated musical sound data to generate a current value of accumulated musical sound data, said musical sound accumulating means including storage means for storing the accumulated musical sound data;

sign detection means, coupled to said changing means and said musical sound accumulating means, for sequentially detecting whether a most significant bit of each of the musical sound data and a most significant bit of the previous value of accumulated musical sound data are both respectively of positive and negative value and for generating sign detect data, upon each accumulation of the musical sound data;

processing capability detection means, coupled to said changing means and said musical sound accumulating means, for sequentially detecting when a magnitude of the musical sound data exceeds a processing capability based upon whether the most significant bit of each of the musical sound data and a most significant bit of the current value of accumulated musical sound data are unequal and for generating processing capability data, upon each accumulation of the musical sound data; and maintaining means, coupled to said musical sound accumulating means, said processing capability detection means, said changing means and said sign detection means, for forcibly maintaining a value of a processed musical sound data output thereof at a maximum amplitude based upon said sign detect data and said processing capability data, upon each accumulation of the musical sound data, the processed musical sound data being forcibly maintained at a maximum amplitude wherein a most significant bit of processed musical sound data is set equal to the most significant bit of the musical sound data and the remaining least significant bits of the processed musical sound data are set equal to the most significant bit of the current value of accumulated musical sound data.

2. The musical sound data processing system of claim 1, said processing capability detection means comprising:

an inverter, coupled to said sign detection means, for generating inverted sign detect data;

an exclusive-OR gate, coupled to said changing means and said musical sound accumulating means, for receiving the most significant bit of the musical sound data and the current value of accumulated musical sound data and generating processing detect data; and an AND gate, coupled to said exclusive-OR gate and said inverter, for receiving said sign detect data and said processing detect data and generating said processing capability signal.

3. The musical sound data processing system of claim 2, wherein said sign detection means comprises an exclusive-OR gate.

4. A method of musical sound data processing for use in a musical sound data processing system comprising the steps of:

(a) storing a plurality of musical sound data of a half wavelength;

(b) sequentially generating the plurality of musical sound data of the half wavelength in a time sharing manner;

(c) generating a detection signal indicative of a period of the half wavelength of the musical sound data generated in said step (b);

(d) sequentially receiving and outputting during a first half wavelength period each of the musical sound data generated in said step (b) in a time sharing manner and sequentially outputting during a second half wavelength period each of the musical sound data generated in said step (b) in a time sharing manner inverted, in accordance with the detection signal;

(e) sequentially accumulating and adding the output of said step (d) to a previous value of accumulated musical sound data to generate a current value of accumulated musical sound data and storing the accumulated musical sound data;

(f) sequentially detecting whether a most significant bit of each of the musical sound data and a most significant bit of the previous value of accumulated musical sound data are both respectively of positive or negative value and generating sign detect data for every accumulation in said step (e);

(g) sequentially detecting when a magnitude of the musical sound data exceeds a processing capability based upon whether the most significant bit of each of the musical sound data and a most significant bit of the current value of the accumulated musical sound data are unequal and generating processing capability data for every accumulation in said step (e); and (h) forcibly maintaining a value of a processed musical sound data output thereof at a maximum amplitude based upon the sign detect data of said step (f) and the processing capability data of said step (g) for every accumulation of said step (e), the processed musical sound data being forcibly maintained at a maximum amplitude wherein a most significant bit of the processed musical sound data is set equal to the most significant bit of the musical sound data and the remaining least significant bits of the processed musical sound data are set equal to the most significant bit of the current value of accumulated musical sound data.

5. A musical sound data processing system comprising:

musical sound data storage means for storing a plurality of musical sound data;

musical sound generating means for sequentially generating the plurality of musical sound data, which is stored in said musical sound data storage means, in a time sharing manner, the plurality of musical sound data being separated into plural groups;

musical sound accumulating means, coupled to said musical sound generating means, for sequentially and separately accumulating and adding the musical sound data of each of the plural groups to respective previous values of accumulated musical sound data of the plural groups to separately generate a current value of accumulated musical sound data of each of the plural groups, said musical sound accumulating means including accumulating storage means for separately storing the accumulated musical sound data of each of the plural groups;

sign detection means, coupled to said musical sound accumulating means, for sequentially and separately detecting whether a most significant bit of each of the musical sound data of the plural groups and a most significant bit of the previous value of accumulated musical sound data of each of the plural groups are both respectively of positive or negative value and for generating sign detect data indicative thereof;

processing capability detection means, coupled to said musical sound accumulating means, for sequentially and separately detecting when a magnitude of the accumulated musical sound data exceeds a processing capability based upon whether the most significant bit of the musical sound data of each of the plural groups and a most significant bit of the current value of accumulated musical sound data of each of the plural groups are respectively unequal and for generating processing capability data indicative thereof; and maintaining means, coupled to said musical sound accumulating means, said processing capability detection means and said sign detection means, for forcibly maintaining a value of a processed musical sound data of each of the plural groups output thereof at a maximum amplitude based respectively upon said sign detect data and said processing capability data.

6. The musical sound data processing system of claim 5, wherein said musical sound generating means comprises:

waveform generating means for generating a waveform based upon stored waveform data;

envelope generating means for generating an envelope based upon stored envelope data; and multiplying means for multiplying the waveform generated by said waveform generating means by the envelope generating means to generate the musical sound data.

7. The musical sound data processing system of claim 5, wherein said musical sound accumulating means comprises:

reading means for reading the accumulated musical sound data of each of the plural groups from said accumulating storage means, a reading cycle of said reading means being greater than a time sharing cycle of said musical sound generating means.

8. The musical sound data processing system of claim 5, wherein said processing capability detection means comprises:

an inverter, coupled to said sign detection means, for generating an inverted sign detect signal for each of the plural groups:

an exclusive-OR gate, coupled to said musical sound generating means and said musical sound accumulating means, for respectively performing an exclusive-OR operation of the most significant bit of the musical sound data and the current value of accumulated musical sound data, to generate a processing detect signal for each of the plural groups; and an AND gate, coupled to said exclusive-OR gate and said inverter, for performing an AND operation of the outputs thereof to generate the processing capability signal for each of the plural groups.

9. The musical sound data processing system of claim 5, wherein said sign detection means comprising an exclusive-OR gate.

10. The musical sound data processing system of claim 5, wherein the processed musical sound data of each of the plural groups which is forcibly maintained at the maximum amplitude respectively includes a most significant bit which equals the most significant bit of the musical sound data generated by said musical sound generating means and the remaining least significant bits equal the significant bit of the accumulated musical sound data.

11. A method of musical sound processing for use in a musical sound data processing system comprising the steps of:

(a) storing a plurality of musical sound data;

(b) sequentially generating the plurality of musical sound data, which is stored in said step (a), in a time sharing manner, the plurality of musical sound data being separated into plural groups;

(c) sequentially and separately accumulating and adding the musical sound data of each of the plural groups to respective previous values of accumulated musical sound data of the plural groups to separately generate a current value of accumulated musical sound data of each of the plural groups, said step (c) of accumulating and adding including separately storing the accumulated musical sound data of each of the plural groups;

(d) sequentially and separately detecting whether a most significant bit of each of the musical sound data of each of the plural groups and a most significant bit of the previous value of accumulated musical sound data of each of the plural groups are both respectively of positive or negative value and for generating sign detect data indicative thereof;

(e) sequentially and separately detecting when a magnitude of the accumulated musical sound data exceeds a processing capability based upon whether the most significant bit of the musical sound data of each of the plural groups and a most significant bit of the current value of accumulated musical sound data of each of the plural groups are respectively unequal and for generating processing capability data indicative thereof; and (f) forcibly maintaining a value of a processed musical sound data of each of the plural groups output thereof at a maximum amplitude based respectively upon the sign detect data and the processing capability data.

12. The method of musical sound data processing of claim 11, wherein said step (b) of sequentially generating the plurality of musical sound data comprises the steps of:

(b1) generating a waveform based upon stored waveform data;

(b2) generating an envelope based upon stored envelope data; and (b3) multiplying the waveform generated in said step (b1) by the envelope generated in said step (b2) to generate the musical sound data.

13. The method of musical sound data processing of claim 11, wherein said step (c) comprises:

reading the accumulated and stored musical sound data of each of the plural groups in accordance with a reading cycle which is greater than a time sharing cycle of said step (b).

14. The method of musical sound data processing of claim 11, wherein said step (e) comprises the steps of:

(e1) generating an inverted sign detect signal for each of the plural groups;

(e2) performing an exclusive-OR operation of the most significant bit of the musical sound data, and the current value of accumulated musical sound data to generate a processing detect signal for each of the plural groups; and (e3) performing an AND operation of the inverted sign detect signal and the processing detect signal to respectively generate the processing capability data for each of the plural groups.

15. The method of musical sound data processing of claim 11 wherein said step (d) comprises performing an exclusive-OR operation of the most significant bit of musical sound data and the most significant bit of the previous value of accumulated musical sound data to respectively generate the sign detect data for each of the plural groups.

16. The method of musical sound data processing of claim 11, wherein the processed musical sound data of each of the plural groups which is forcibly maintained at the maximum amplitude respectively includes a most significant bit which equals the most significant bit of the musical sound data generated in said step (a) and the remaining least significant bits equal the most significant bit of the accumulated musical sound data of said step (c).

* * * * *